US005495707A

United States Patent [19]

Lauzon

[11] Patent Number: 5,495,707

[45] Date of Patent: Mar. 5, 1996

[54] BAGGING MACHINE WITH IN-LINE ATTACHING MECHANISM

[75] Inventor: Robert Lauzon, Montreal, Canada

[73] Assignee: Glopak, Inc., Quebec, Canada

[21] Appl. No.: 263,598

[22] Filed: Jun. 22, 1994

[51] Int. Cl.[6] ..... B65B 43/28; B65B 43/54; B65B 51/14

[52] U.S. Cl. ..... 53/572; 53/370.7

[58] Field of Search ..... 53/572, 385.1, 53/370.7, 371.2, 136.5, 479, 469

[56] References Cited

U.S. PATENT DOCUMENTS

| | | | |
|---|---|---|---|
| 3,407,567 | 10/1968 | Hudson | 53/385.1 |
| 3,698,153 | 10/1972 | Lieberman | 53/572 X |
| 3,822,527 | 7/1974 | Germunson et al. | 53/385.1 X |
| 4,172,349 | 10/1979 | Lipes | 53/572 X |
| 4,253,292 | 3/1981 | Lipes | 53/572 X |
| 4,291,517 | 9/1981 | Lipes | 53/572 X |
| 4,706,298 | 11/1987 | Lipes | 53/479 X |
| 4,798,042 | 1/1989 | Davis | 53/572 |
| 4,989,391 | 2/1991 | Wetter | 53/572 X |
| 5,172,537 | 12/1992 | Wetter et al. | 53/572 |
| 5,177,939 | 1/1993 | Lipes | 53/572 |
| 5,199,794 | 4/1993 | Lipes | 383/71 |

*Primary Examiner*—Horace M. Culver
*Attorney, Agent, or Firm*—Longacre & White

[57] ABSTRACT

An automatic bagging machine wherein one or more articles are discharged in an open top end of a plastic bag which is held and supported at a discharge location. A plurality of collapsed and juxtaposed bags are held adjacent a discharge location. An outermost one of the juxtaposed bags is opened while still being retained with the other bags. As the articles are discharged within the open top end of the outermost bag, they cause the bag to separate from the plurality of juxtaposed bags, but the outermost bag is still retained and supported at the discharge location. A bag closing and displacing mechanism then forms a gathered neck portion of the bag which is then released and displaced to an attaching device.

6 Claims, 2 Drawing Sheets

BAGGING MACHINE WITH IN-LINE ATTACHING MECHANISM

TECHNICAL FIELD

The present invention relates to an automatic bagging machine wherein an outermost one of a plurality of juxtaposed collapsed plastic bags held at a discharge location is filled with articles or a product and is detached from the juxtaposed bags without disturbing an adjacent bag, and is then gathered in a top end thereof to form a gathered neck portion which is then attached by an attaching device which is positioned horizontally adjacent the discharge location.

BACKGROUND ART

Various plastic bag filling and closing devices are known wherein a product is introduced into a bag which is then detached from juxtaposed bags and transferred to a bag closing or sealing station. An example of such device is disclosed in U.S. Pat. No. 5,177,939; entitled "Bagging Machine with Bag Holding, Transfer and Stretch Means". A disadvantage of many bagging machines wherein a plurality of juxtaposed collapsed bags are held adjacent a filling station is that, when the outermost bag is opened to receive a product therein, it will often will draw the next bag therealong, due to friction or static, or other reasons, and then often making it difficult, if not impossible, for the next bag to be opened by the bag opening mechanism. This results in machine malfunction, and it is then necessary to stop the machine, remove the broken bags and the discharge product(s) that may have been discharged directly onto the machine during the malfunction, and reposition the juxtaposed bags in proper position. This machine stoppage and damage to the product is time consuming and costly.

A further disadvantage of bagging machines is that, after a bag has been filled, most often the bag is conveyed to a remote bag closing machine or station. The result of this is that a very large machine or system is required to place articles in bags, close the bags and introduce a bag closure to retain the bags closed, and then transfer the bags away from the machine. These different bag handling devices also slow down the bagging process.

SUMMARY OF INVENTION

It is a feature of the present invention to provide an automatic bagging machine which substantially overcomes the above-mentioned disadvantages of the prior art.

Another feature of the present invention is to provide an automatic bagging machine wherein a first bag of a plurality of juxtaposed collapsed plastic bags is separated from the juxtaposed bags while being filled without disturbing the adjacent collapsed bag, and wherein the outermost bag is closed, and transferred to an adjacent bag closing device, permitting the next outermost bag to be opened and filled while the first outermost bag is being attached in its closed position and conveyed away from the machine.

Another feature of the present invention is to provide an automatic bagging machine which overcomes the above-mentioned disadvantages of the prior art, and which is very compact and substantially malfunction-free.

According to the above features, from a broad aspect, the present invention provides an automatic bagging machine which comprises product discharge means for discharging one or more articles in an open top end of a plastic bag held and supported at a discharge location under said discharge means. Bag holding means is provided for holding a plurality of collapsed juxtaposed plastic bags adjacent the discharge location. The bag holding means has bag opening means for opening a mouth of an outermost one of the bags to form the open top end. Automatic bag separation means permits the outermost one of the bags adjacent the discharge location to be separated from the plurality of juxtaposed bags simultaneously when the one or more articles are discharged in the open top end thereof while maintaining retention and support of the bag at the discharge location. Means is provided for displacing the bag with the articles therein away from the discharge location.

BRIEF DESCRIPTION OF DRAWINGS

A preferred embodiment of the invention will now be described with reference to the accompanying drawings in which.

DESCRIPTION OF PREFERRED EMBODIMENTS

Figure 1:
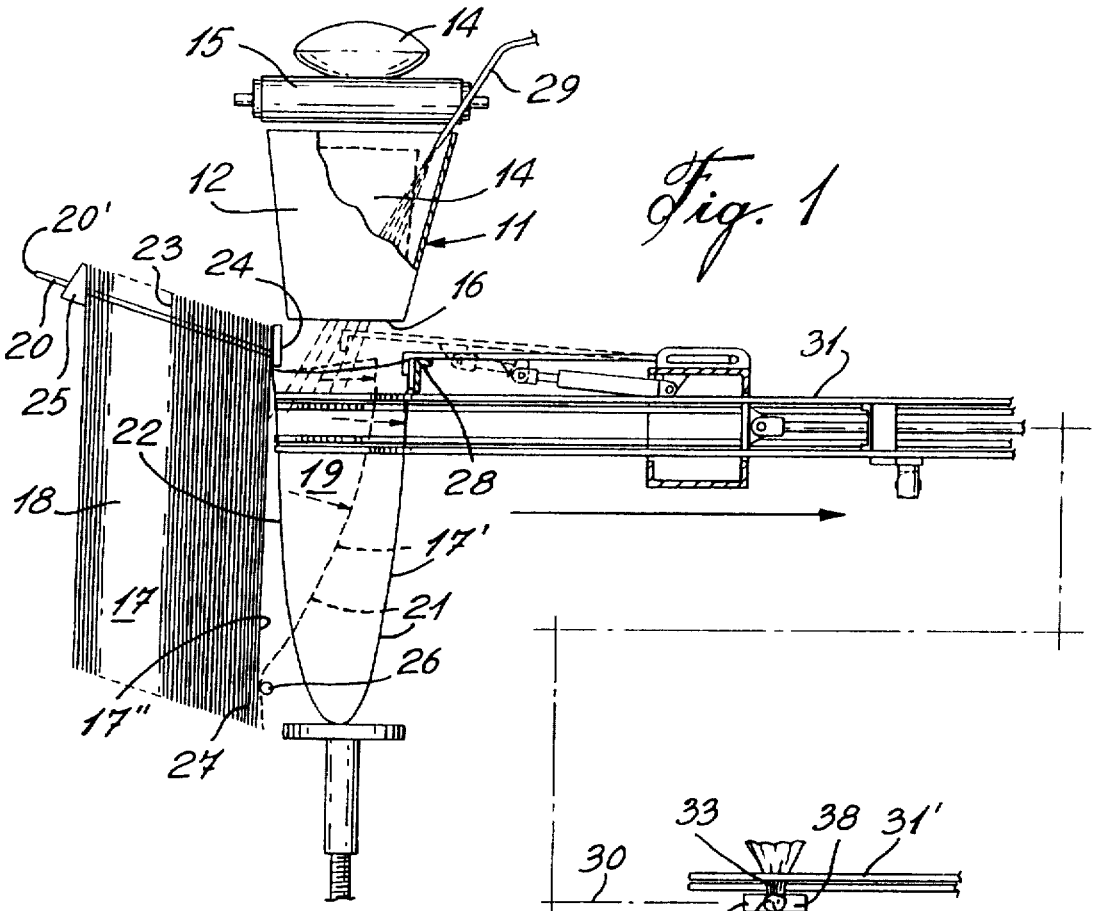
FIG. 1 is a simplified side view illustrating the construction and operation of the automatic bagging machine of the present invention.

Referring now to the drawings, there is shown generally at 10 the automatic bagging machine of the present invention. The machine comprises a product discharge means 11, herein constituted by a housing 12 which contains compartments 13 in which liquid containing pouches 14 are discharged by a conveyor 15. Once the compartments are filled with a pouch, a bottom trap door 16 is opened and the pouches 14 are discharged within a bag 17 held in an open position under the trap door.

As shown in FIG. 1, a plurality of collapsed juxtaposed collapsed plastic bags 18 are supported adjacent the discharge location 19 on wicker pins 20. The bags are each formed with a front wall 21, a back wall 22, and a top flap 23 formed at a top end of the back wall 22. The flap 23 is provided with holes through which a pair of wicker pins 20 extend. The bags are loaded on the wicker pins from the rear end 20' thereof, and are maintained in close frictional support relationship. Clamping means in the form of a piston-operated clamp bar 24 and a pusher weight 25, which slides downwardly on the wicker pins as the bags are being removed therefrom, provide pressure across the flaps to maintain and move the suspended juxtaposed bags towards the discharge location 19. An arresting means in the form of a retaining bar 26 provides abutment for a lower end portion 27 of the outermost one of the juxtaposed bags 17'. This retaining bar prevents the next adjacent outermost ones of the bags from being drawn with the outermost bag as it is opened at the discharge location 19, and pulled over the bar 26 by the pulling force of the product released in the open bag, as illustrated in FIG. 1.

Bag opening means in the form of a piston-operated clamp 28 is provided to draw the outer wall 21 of the outermost ones of the bags 17' to its open position, as shown in FIG. 1. An air jet 29 blows air in the direction of the mouth opening of the collapsed outermost bag causing the closed mouth to open permitting the clamp 28 to grab the upper edge of the front wall 21 of the outermost one of the juxtaposed bags 17', and pull it to an open position under the trap door 16. The bag is thus held between the pins 20 and the clamps 24 and 28 in a position to receive the product, herein the pouches 14, therein. In this position it is pointed out that the lower end portion 27 of the bag and the rear wall 22 are still held in juxtaposition with the other bags 18 by the retaining bar 26.

As soon as the pouches 14 are discharged within the open top end of the outermost bag 17', the pouches will apply an outer pulling force on the front wall 21 of the bag 17' to cause the lower end portion 27 of the bag 17' to be drawn over the retaining bar 26 causing the rear wall 22 of the bag to move away from the next juxtaposed bag 17". This action is illustrated by the position of the bag. as shown in phantom lines in FIG. 1. Accordingly, the loading of the products within the outermost bag constitutes an automatic bag separating means to separate the outermost bag, while maintaining retention and support of the adjacent outermost ones of the bags 17". As the outermost bag 17' is drawn away from the juxtaposed bags 18, the clamping bar 24 still engages the flap of the outermost bag 17'. The outermost bag 17' is also supported on a support means, herein surface 30 spaced under the discharge means 11.

Figure 3A:
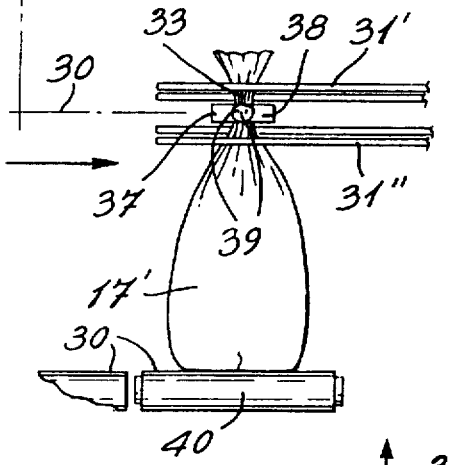
FIGS. 3A to 3C are schematic illustrations showing the bag closing sequence to form a gathered neck portion adjacent the open top end of the bag.
Figure 3B:
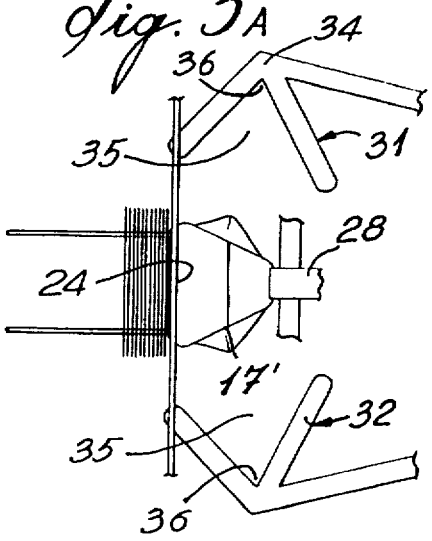
Figure 3B:
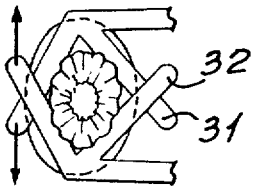
Figure 3C:
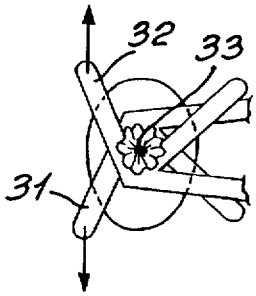
Figure 2:
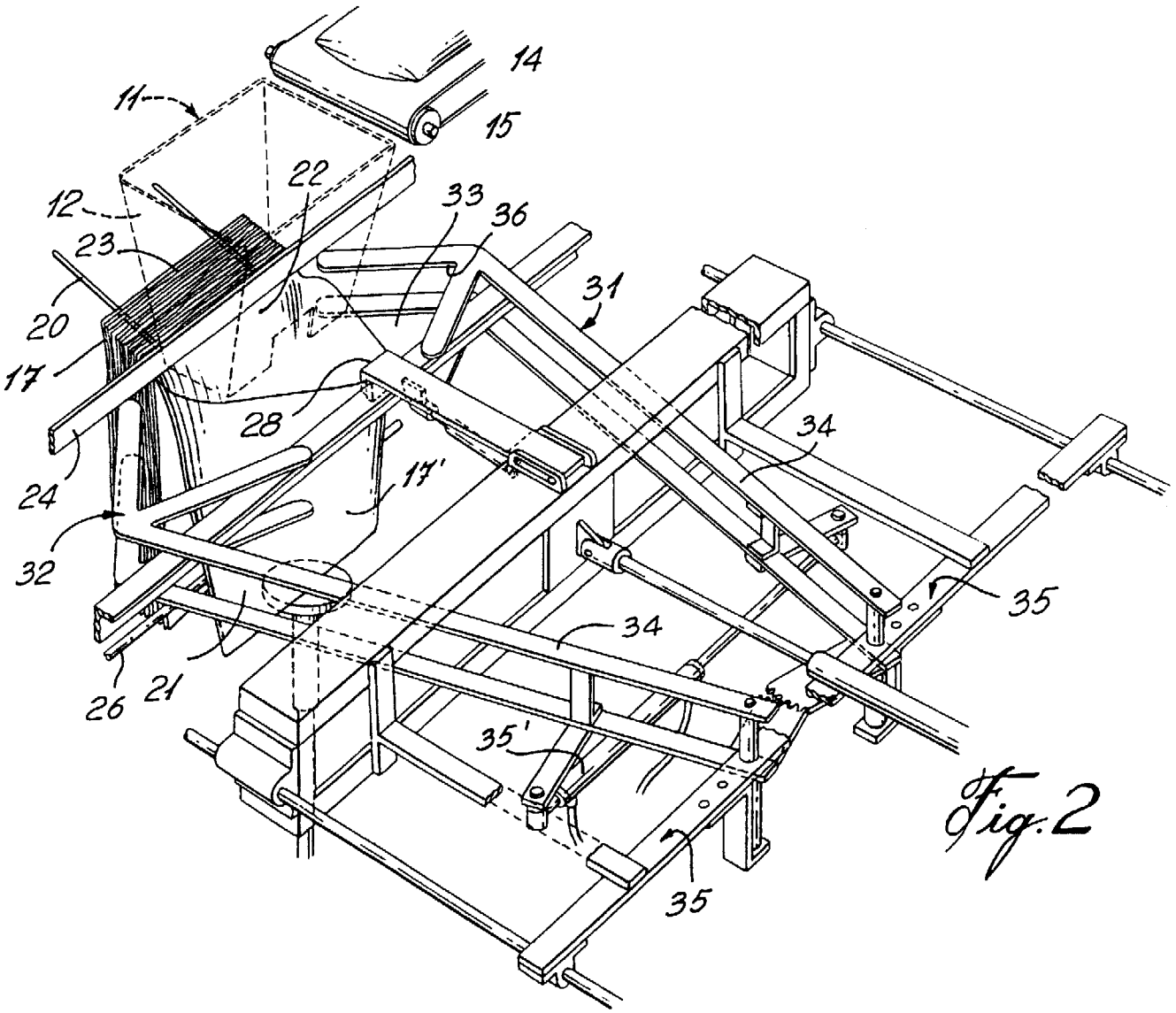
FIG. 2 is a perspective view illustrating the bag opening and closing mechanisms.

As illustrated more clearly in FIGS. 2 and 3, a bag gathering and displacing means in the form of a first and second pair of V-shaped gathering arms 31 and 32 move into position on each side of the outermost bag 17', as shown in FIG. 3, to grab the bag under the open top end thereof to form a gathered neck portion 33, as shown in FIGS. 1, 3A and 3B. The pairs of V-shaped arms are secured to a connector 34 which in turn is secured to a piston-operated linkage 35 which moves the arms towards the side of the open bag 17' and towards one another. These pair of arms 31 and 32 are spaced apart vertically and aligned with one another, and offset with the other pair of arms whereby the bags are engaged at spaced intervals, illustrated at 31' and 31" in FIG. 1 and from both sides. When these V-shaped arms 31 and 32 are moved towards one another from a respective side of the outermost one of the bags 17', they define a gathered neck portion 33 therebetween. The sequence of gathering the bag is illustrated in FIGS. 3A to 3C, and once the arms have reached their position, as shown in FIG. 3C, the piston-operated clamp 28 is released. However, at an appropriate time in the sequence the clamp bar 24 is also released permitting the bag to tear away from the wicker pins 20 as it is being drawn by the V-shaped arms 31. All of the sequences are synchronized by a controller system, not shown, but obvious to a person skilled in the art.

As herein illustrated, each pair of arms is comprised of a pair of finger bars which define a mouth 35 with a large open end and which narrows to a trough end 36. This causes the upper end portion of the bag to be embraced by the arms and gathered to form the gathered neck portion, also permitting engagement of the bag 17' for transferring the bag to an attaching device 37. It is pointed out that the bag is transferred in line on the support surface 30, and that the attaching device 37 is positioned adjacent the loading station. This permits for the discharge location to be vacated quickly so that the next outermost ones of the bags 17" can then be opened and filled in the sequence repeated, and while this is being done the gathered neck portion 33 of the first outermost bag 17, is being attached or sealed. Thereafter, the pair of arms repeat the closing and transfer sequence.

As shown in FIG. 1, the attaching device consists of a pin sealer of a type known in the art, as disclosed in my U.S. Pat. No. 4,706,298 or U.S. Pat. No. 5,199,794, and consists of a clamp 38 having heated pins 39, which are caused to move into the gathered neck portion 33, to fuse portions of the gathered plastic therein to form a bag closure. It is to be understood that the attaching device 37 may also be constituted by other well known bag closure devices capable of attaching a closure tag or a strap about the gathered neck portion 33.

Briefly summarizing the method of operation of the automatic bagging machines of the present invention for placing articles in an outermost one of a plurality of juxtaposed plastic bags. These juxtaposed collapsed plastic bags are retained adjacent a product discharge means, and the method comprises opening a mouth of an outermost one of the bags under the discharge means, and then discharging one or more articles from the discharge means into the open mouth of the outermost one of the bags. Simultaneously, as the articles are discharged in the outermost one of the bags, the outermost bag is separated from the plurality of juxtaposed bags while maintaining retention and support of the outermost filled bag under the discharge means. The outermost one of the bags is then grabbed by a gathering means to form a gathered neck portion adjacent the open top end of the bag while detaching the outermost bag from wicker pins and releasing clamps which were holding the bag open. The outermost one of the bag was separated from the juxtaposed collapsed bags by a pulling force which was applied to the front wall panel 21 of the outermost bag 17' by the discharge of the articles in the bag, and this caused a lower portion of the outermost bag to be drawn over a bottom retaining bar 26, also permitting the next outermost bag 17" to be arrested by the bar. The filled bag with the gathered neck portion is then displaced horizontally by the gathering means, herein the V-shaped arms 31, and on a horizontal support surface 30, to an adjacent bag attaching station where an attaching device, herein the pin sealer, causes the gathered neck portion to be secured closed. A discharge conveyor 40 is then automatically actuated to move the closed bag to a discharge location and the sequence is repeated. It can be seen that, because the filled bag is moved horizontally to a sealing station adjacent the discharge location, the machine is very compact, and it also liberates the discharge location permitting the filling of the next bag as soon as the filled bag is vacated.

It is within the ambit of the present invention to cover any obvious modifications of the preferred embodiment described herein, provided such modifications fall within the scope of the appended claims.

I claim:

1. An automatic bagging machine for use in combination with article discharge means for discharging one or more articles in an open top end of a plastic bag held and supported at a discharge location under said discharge means, bag holding means for holding a plurality of collapsed juxtaposed bags adjacent said discharge location, said bag holding means comprises support means for displaceably engaging a top flap of said juxtaposed bags above said mouth opening, and a stationary arresting element for frictional retention of a lower end portion of said outermost one of said bags adjacent said discharge location, said bag holding means having bag opening means for opening a mouth of an outermost one of said bags to form said open top end, automatic bag separation means to permit said outermost one of said bags adjacent said discharge location to be separated from said plurality of juxtaposed bags simultaneously when said one or more articles are discharged in said open top end thereof while maintaining retention and support of said bag at said discharge location, and means for horizontally displacing said bag with said articles therein away from said discharge location; said automatic bag separation means being comprised of the combination of said bag holding means, said stationary arresting element and said bag opening means whereby the introduction of said one or more articles in said mouth opening of said outermost one of said bag will apply a pulling force on said outer side wall of said outermost one of said bags causing said outermost one of said bags to be pulled from said stationary arresting element and an adjacent bag becoming in contact and frictionally arrested by said stationary arresting element, said means for horizontally displacing said bag with said articles therein comprises gathering means for gathering an upper end portion of said bag below said open top end to form a gathered neck portion, pulling means to move said gathering means along a horizontal plane to pull said outermost one of said bags to an attaching device for attachment of said gathered neck portion of said bag, discharge means for discharging said attached bag from said bagging machine, said gathering means being comprised of a first and second pair of bag gathering and engaging V-shaped arms, each pair of arms being spaced apart vertically and aligned with one another and offset with said other pair of arms to engage said bag at spaced intervals when displaced towards one another on a pivot connection from a respective side of said outermost one of said bags to define said gathered neck portion between said pairs of arms by gathering a top portion of said bag into opposed trough ends of said V-shaped arms, said V-shaped arm of each pair of arms have a pair of fingers defining a mouth with a large open end which narrows to said trough end, said arms being mounted on a displacement mechanism to move said arms toward one another to embrace said upper end portion of said bag and retain said bag, said arms being secured to a carriage which is displaceable in-line in said horizontal plane between said discharge location and said attaching device where said bag is discharged.

2. An automatic bagging machine as claimed in claim 1 wherein said stationary arresting element is a retaining bar extending across said lower end portion of said outer side wall of said outermost one of said bags, said outermost one of said bags having a lower end thereof pulled over said retaining bar by said pulling force on said outer side wall.

3. An automatic bagging machine as claimed in claim 2 wherein said support means is comprised by a pair of wicker pins extending through a pair of holes provided in each said flap of said juxtaposed bags, and clamping means between said wicker pins for clamping retention of said juxtaposed flaps, said clamping means being released when said means for displacing said bag with said articles therein pulls the bag away from said discharge location.

4. An automatic bagging machine as claimed in claim 1 wherein said attaching device is a pin sealer having heated pins which penetrate said gathered neck portion to fuse portions of said plastic bag in said gathered neck portion to form a bag closure.

5. An automatic bagging machine as claimed in claim 1 wherein said product discharge means is an open top end housing having a bottom trap wall to release said one or more articles in said outermost one of said bags through said open top end of said bag.

6. An automatic bagging machine as claimed in claim 1 wherein there is provided a bag support means at said discharge location and spaced under said product discharge means and adjacent said outermost bag of said plurality of juxtaposed bags.

* * * * *